US009481975B2

(12) United States Patent
Saotome

(10) Patent No.: US 9,481,975 B2
(45) Date of Patent: Nov. 1, 2016

(54) CONSTRUCTION MACHINE

(75) Inventor: Yoshimi Saotome, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 370 days.

(21) Appl. No.: 14/127,756

(22) PCT Filed: Jun. 27, 2012

(86) PCT No.: PCT/JP2012/004160
§ 371 (c)(1),
(2), (4) Date: Dec. 19, 2013

(87) PCT Pub. No.: WO2013/005393
PCT Pub. Date: Jan. 10, 2013

(65) Prior Publication Data

US 2014/0123640 A1 May 8, 2014

(30) Foreign Application Priority Data

Jul. 1, 2011 (JP) ..... 2011-147270

(51) Int. Cl.
*F16D 31/02* (2006.01)
*E02F 3/43* (2006.01)
(Continued)

(52) U.S. Cl.
CPC ..... *E02F 3/435* (2013.01); *E02F 9/2239* (2013.01); *E02F 9/2282* (2013.01); *E02F 9/2285* (2013.01); *E02F 9/2292* (2013.01); *F15B 11/17* (2013.01)

(58) Field of Classification Search
CPC ..... E02F 9/2239; E02F 9/2282
USPC ..... 60/429, 421
See application file for complete search history.

(56) References Cited

U.S. PATENT DOCUMENTS 6,330,797 B1 12/2001 Kondo
2002/0014074 A1 2/2002 Ehara et al.
(Continued)

FOREIGN PATENT DOCUMENTS

CN 1336492 A 2/2002
CN 1573126 A 2/2005
(Continued)

OTHER PUBLICATIONS

International Search Report Issued Jul. 31, 2012 in PCT/JP12/004160 Filed Jun. 27, 2012.

*Primary Examiner* — John K Fristoe, Jr.
*Assistant Examiner* — Daniel Collins
(74) *Attorney, Agent, or Firm* — Oblon, McClelland, Maier & Neustadt, L.L.P.

(57) ABSTRACT

A construction machine including: a swivel motor; a working attachment having a boom, a boom cylinder, an arm and an arm cylinder; a hydraulic actuator circuit having a first circuit including the boom cylinder and a boom control valve, a second circuit including the arm cylinder and an arm control valve, and a third circuit including the swivel motor and a swivel control valve; first to third pumps for the first to third circuits; a merge valve having a first position for merge of third pump fluid into the first circuit and connection of an unload line of the third circuit to a tank, and a second position for prohibiting the merge; and a merge selecting control section which holds the merge valve at the first position either of when only a swivel operation is performed and when a boom raising operation is performed.

9 Claims, 4 Drawing Sheets

(51) Int. Cl.
*E02F 9/22* (2006.01)
*F15B 11/17* (2006.01)

(56) References Cited

U.S. PATENT DOCUMENTS

| | | | | |
|---|---|---|---|---|
| 2003/0089106 | A1* | 5/2003 | Ioku ..... | E02F 9/2239 60/328 |
| 2004/0231326 | A1 | 11/2004 | Imanishi et al. | |

FOREIGN PATENT DOCUMENTS

| | | | |
|---|---|---|---|
| CN | 1699761 | A | 11/2005 |
| EP | 1 598 561 | A2 | 11/2005 |
| JP | 55 105033 | | 8/1980 |
| JP | 8-41934 | A | 2/1996 |
| JP | 2000 220168 | | 8/2000 |
| JP | 2003-148414 | A | 5/2003 |
| JP | 2003 184815 | | 7/2003 |
| JP | 3681833 | | 8/2005 |

* cited by examiner

12
SWIVEL
21
23
24
15
25
P1
P2
P3
22a
22
22b
36
26
27
C3
BOOM
LOWERING
PILOT
PRESSURE
33
29
33a
32
30
34a
28
31
ARM
7
34
T
19
19a
11
RIGHT
TRAVEL
C2
14
20
20a
35
13
10
LEFT
TRAVEL
18
18a
T
6
BOOM
16
16a
30
C1
8
BUCKET
17
17a
T

SWIVEL
12
21
23
24
15
25
P1
P2
P3
22a
22
22b
36
26
27
33
29
33a
32
30
34a
31
28
C3
BOOM
LOWERING
PILOT
PRESSURE
ARM
7
34
19
19a
11
RIGHT
TRAVEL
20
20a
14
35
C2
T
13
37
10
LEFT
TRAVEL
18
18a
6
BOOM
16
16a
30
C1
8
BUCKET
17
17a

CONSTRUCTION MACHINE

TECHNICAL FIELD

The present invention relates to a construction machine having first, second and third pumps and respective circuits which correspond to the pumps.

BACKGROUND ART

The related art of the present invention is described here by taking the hydraulic excavator shown in FIG. 5 as an example.

This hydraulic excavator is provided with a lower travel body 1 of a crawler type, an upper swivel body 2 mounted swivelably about a vertical axis X with respect to the ground surface on, the lower travel body 1, and an attachment 9 installed on the upper swivel body 2; the attachment 9 includes a boom 3, an arm 4, a bucket 5 and respective hydraulic actuators for actuating the boom 3, arm 4 and bucket 5, namely, a boom cylinder 6, an arm cylinder 7 and a bucket cylinder 8. The hydraulic excavator further includes, as other hydraulic actuators, left/right travel motors which cause the lower travel body 1 to travel by driving respective left and right crawlers included in the lower travel body 1, and a swivel motor which drives and swivels the upper swivel body 2.

In a hydraulic excavator of this kind, a three-circuit/three-pump system such as that shown in Patent Document 1 is known as a drive system for ensuring independence between the swivel operation and the operations of the other actuators. In this system, the hydraulic circuits for this driving are divided into: i) a first circuit which includes one travel motor of the left/right travel motors and the boom cylinder 6; ii) a second circuit which includes the other travel motor and the arm cylinder 7; and iii) a third circuit which includes the swivel motor. The first to third circuits are provided with first to third pumps respectively.

The circuit disclosed in Patent Document 1 further includes a merge valve which switches the path of the hydraulic fluid discharged by the third pump. This merge valve, which has a first position as a neutral position and a second position, is switched from the first position to the second position in the case of combined operations in which a boom raising operation and a swivel operation are carried out simultaneously. In the second position, the merge valve forms a fluid path for supplying third pump fluid, which is the hydraulic fluid discharged by the third pump, to the boom cylinder in parallel with the swivel motor, that is, for causing the third pump fluid to merge into the first pump fluid, which is the hydraulic fluid discharged by the first pump.

The merge valve, however, has a response delay when switching from the first position to the second position, which generates a risk of causing a shock in the swivel action. For example, in a case of starting a boom raising operation while a swivel operation is applied, if the merge valve is switched from the first position to the second position simultaneously with the start of the boom raising operation, then the maximum pressure (swivel pressure) of the swivel motor declines gradually during the boom raising operation; however, if the merge valve is switched to the second position after a delay from the start of the boom raising operation (in other words, if the merge valve is switched to the second position in a state where the boom raising operation has progressed to a certain extent), then the third pump fluid is switched suddenly from a state of being supplied only to the swivel motor, to a state of being supplied in parallel to the swivel motor and the boom cylinder, which causes the maximum pressure (swivel pressure) of the swivel motor to change suddenly from a relief pressure to a boom operating pressure, thereby generating possibility of giving marked shocks to the swivel operation. Shocks of this kind can be a cause of decline in the operation performance.

Patent Document 1: Japanese Patent No. 3681833

SUMMARY OF THE INVENTION

The object of the present invention is to provide a construction machine which is capable of effectively suppressing shocks in the torque due to switching of the merge valve when a boom raising operation and a swivel operation are carried out simultaneously. The construction machine provided by the present invention includes: a lower travel body; an upper swivel body mounted swivelably on the lower travel body; a swivel motor which hydraulically drives the upper swivel body to swivel it; a working attachment installed on the upper swivel body and including a boom capable of being raised and lowered, a boom cylinder which hydraulically raises and lowers the boom, an arm which is pivotably connected to a front end of the boom, and an arm cylinder which causes the arm to hydraulically pivot; a hydraulic actuator circuit which has a first circuit including the boom cylinder and a boom control valve for controlling an operation of the boom, a second circuit including the arm cylinder and an arm control valve for controlling an operation of the arm cylinder, and a third circuit including the swivel motor and a swivel control valve for controlling an operation of the swivel motor; a first pump which is a hydraulic pressure source of the first circuit; a second pump which is a hydraulic pressure source of the second circuit; a third pump which is a hydraulic pressure source of the third circuit; a merge valve having a first position and a second position; and a merge selecting control section which controls switching of the position of the merge valve. At the first position, the merge valve forms a fluid path for causing third pump fluid which is hydraulic fluid discharged by the third pump to merge into the first circuit in parallel with the swivel motor, and, at the second position, the merge valve prohibits the third pump fluid from merging into the first circuit. The merge selecting control section holds the merge valve at the first position, either of when only a swivel operation, which is an operation for the swivel motor, is performed and when a boom raising operation, which is an operation for raising the boom, is performed during the swivel operation.

EMBODIMENTS OF THE INVENTION

Embodiments of the present invention are described here with reference to FIG. 1 to FIG. 5. In each of these embodiments, the present invention is applied to the hydraulic excavator shown in FIG. 5.

Figure 1:
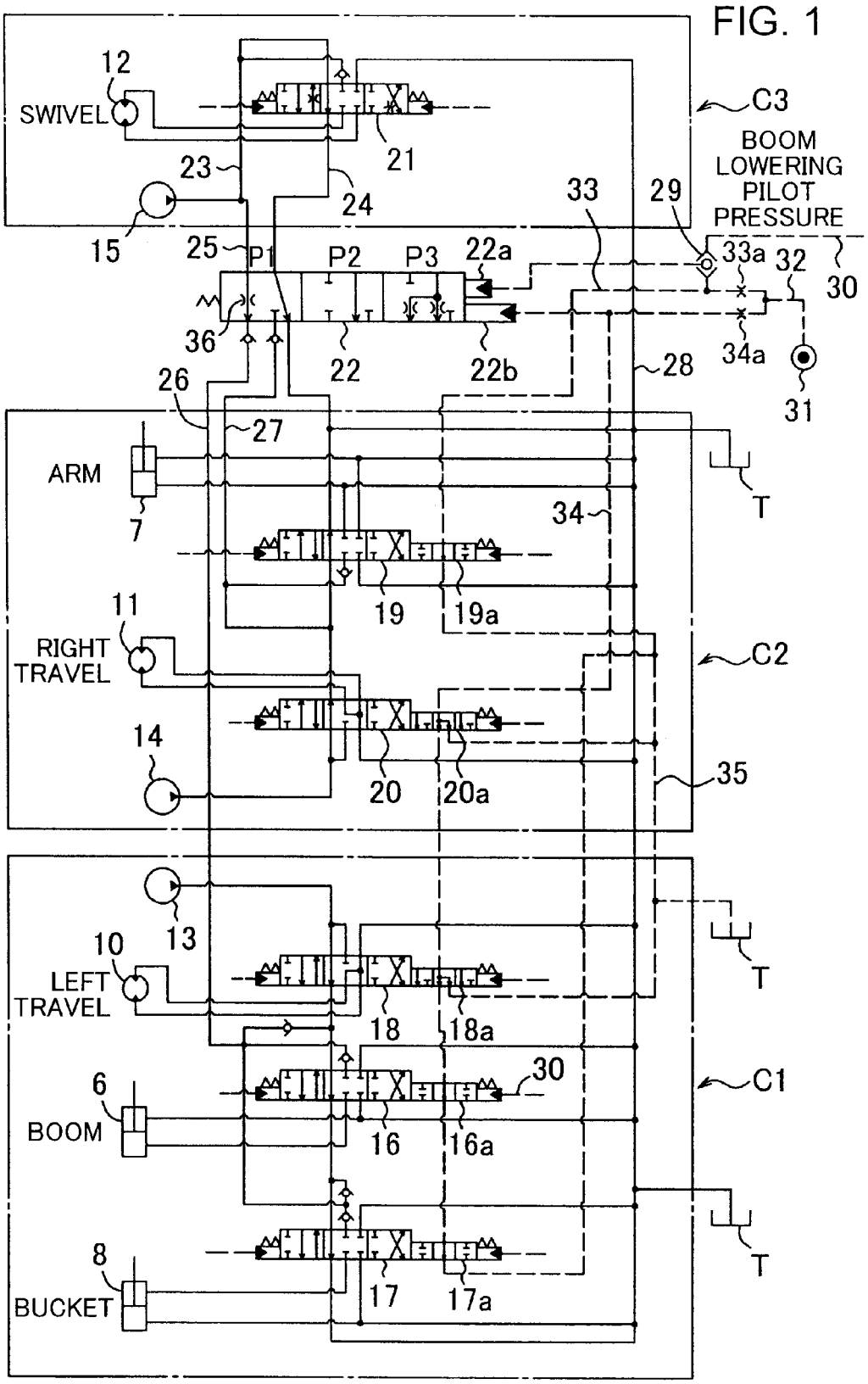
FIG. 1 is a hydraulic circuit diagram showing a first embodiment of the present invention.

FIG. 1 shows a hydraulic circuit according to a first embodiment. The hydraulic circuit includes a hydraulic actuator circuit, a first pump 13, a second pump 14 and a third pump 15 which are hydraulic sources of the hydraulic actuator circuit, and a merge valve 22.

Figure 5:
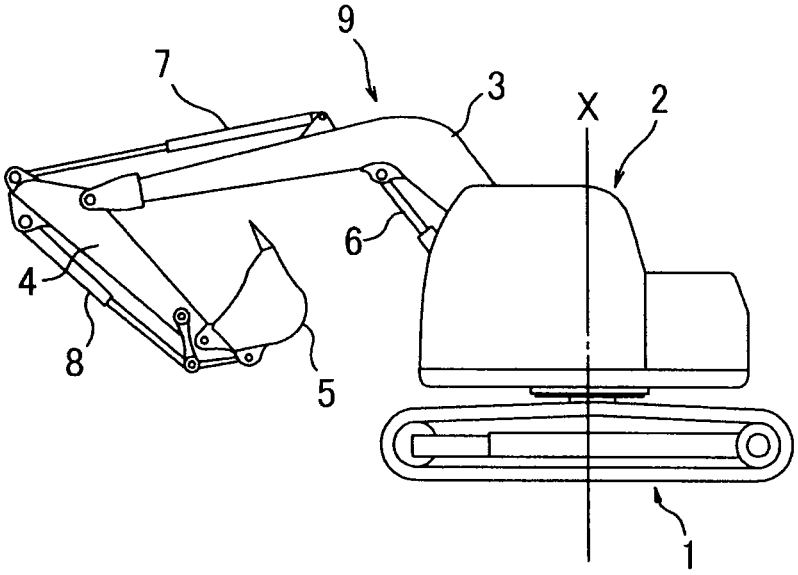
FIG. 5 is a schematic side view of a hydraulic excavator, which is an example of a construction machine to which the present invention is applied.

The hydraulic actuator circuit includes a first circuit C1, a second circuit C2 and a third circuit C3. The first circuit C1 includes, as hydraulic actuators, a left travel motor 10, and a boom cylinder 6 and a bucket cylinder 8 which are shown in FIG. 5. The second circuit C2 includes, as hydraulic actuators, a right travel motor 11, and an arm cylinder 7 shown in FIG. 5. The third circuit C3 includes only a swivel motor 12, as a hydraulic actuator. The first pump 13 is a hydraulic source of the first circuit C1, supplying hydraulic fluid to the left travel motor 10, the boom cylinder 6 and the bucket cylinder 8 which belong to the first circuit C1. The second pump 14 is a hydraulic source of the second circuit C2, supplying hydraulic fluid to the right travel motor 11 and the arm cylinder 7 which belong to the second circuit C2. The third pump 15 is a hydraulic source of the third circuit C3, supplying hydraulic fluid to the swivel motor 12 which belongs to the third circuit C3. The pump 13 to 15 have respective discharge ports, to which respective pump lines are connected, and the pump lines are provided with respective relief valves (not illustrated).

Each of the circuits C1, C2 and C3 includes a control valve provided for each of the hydraulic actuators to control the operation of the hydraulic actuator, and, in the present embodiment, each of the control valves comprises a direction selector valve, which is a hydraulic pilot controlled spool valve. Specifically, the first circuit C1 includes a boom cylinder control valve 16, a bucket cylinder control valve 17, and a left travel motor control valve 18; the second circuit C2 includes an arm cylinder control valve 19 and a right travel motor control valve 20; and the third circuit C3 includes a swivel control valve 21.

The control valves 16, 17, 18, 19 and 20 other than the swivel control valve 21 have respective side bypass portions 16*a*, 17*a*, 18*a*, 19*a* and 20*a*. Each of the side bypass portions is so-called a subsidiary valve whose position is switched in coordinated fashion with the movement of the spool constituting the main valve of the control valve which is provided with the side bypass portion.

In the first and second circuits C1 and C2, in order to prioritize the travel driving of the hydraulic excavator, the travel control valves 18 and 20 are positioned upstream of the other control valves in terms of the flow of hydraulic fluid, and, when a travel operation is performed, first pump fluid, which is the hydraulic fluid discharged from the first pump 13, and second pump fluid, which is the hydraulic fluid discharged from the second pump 14, are supplied preferentially to the left travel motor 10 and the right travel motor 11, respectively. Hence, in the case of applying respective operations for supplying the whole volume of respective hydraulic fluids discharged by the first and second pumps 13 and 14 to the two travel motors 10 and 11 respectively to the travel control valves 18 and 20 during dual travel in which the both travel motors 10 and 11 are driven simultaneously, no hydraulic fluid are supplied from the first and second pumps 13 and 14 to the hydraulic actuators except respective travel motors in the first and second circuits C1 and C2.

The merge valve 22, which serves to ensure the action of the hydraulic actuators other than the travel motors 10 and 11 during dual travel of this kind, is configured to cause the third pump fluid discharged from the third pump 15 towards the third circuit C3 (swivel motor 12), in the case of dual travel, to merge into the first and second circuits C1 and C2, in a tandem or parallel flow with respect to the third circuit C3. The details thereof will be described with reference to FIG. 2

The merge valve 22 comprises a three-position hydraulic pilot controlled selector valve with first and second pilot ports 22*a* and 22*b* on one side thereof, having a first position P1, which is a neutral position for causing the third pump fluid to merge into the first circuit C1, and a second position P2 and a third position P3 for hindering the third pump fluid from merge into the first circuit C1. Specifically, the merge valve 22 is set to the first position P1 when no pilot pressure is introduced to either of the pilot ports 22*a* and 22*b*, and is switched to the second position P2 when a pilot pressure is introduced to the first pilot port 22*a*, and switched to the third position P3 when a pilot pressure is introduced to the second pilot port 22*b*.

The merge valve 22 has first and second input ports, and first, second and third output ports. The first and second input ports are connected to a parallel line 25 and an unload line 24, respectively. The unload line 24 branches off from the pump line 23 of the third pump 15 to form a bleed-off line of the swivel control valve 21, and the parallel line 25 branches off from the pump line 23, separately from the unload line 24. The first output port is connected through a first merge line 26 to the first circuit C1; the second output port is connected through a second merge line 27 to the second circuit C2; and the third output port is connected to a tank line 28 communicating with the tank T.

Figure 2:
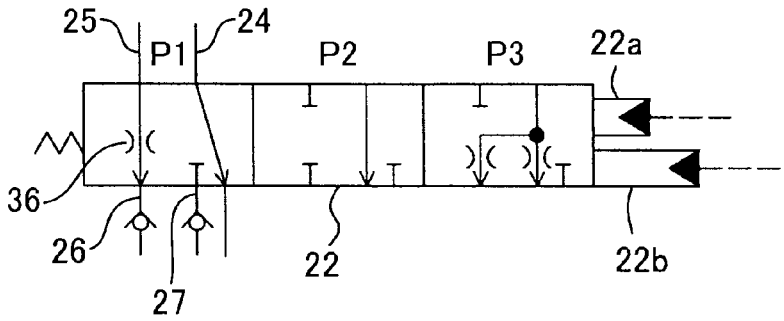
FIG. 2 is an enlarged diagram of a merge valve according to the first embodiment.

As shown in FIG. 2, the merge valve 22, in the first position P1, forms a fluid path for connecting the first and second input ports to the first output and the third output port respectively while blocking the second output port. The fluid path interconnecting the first input port and the first output port is provided with a throttle 36 midway thereof. In the second position P2, the merge valve 22 forms a fluid path for interconnecting the second input port and the second output port while blocking the first input port and the first and third output ports. In the third position P3, the merge valve 22 forms a fluid path for connecting the second input to the first and second output ports via respective throttles while blocking the first input port and the third output port.

The first pilot port 22*a* of the merge valve 22 is connected to a boom lowering pilot line 30 and a primary pilot pressure line 32, via a shuttle valve 29, while the second pilot port 22*b* is connected directly to the primary pilot pressure line 32. The primary pilot pressure line 32 is communicated with the pilot hydraulic pressure source 31. This primary pilot pressure line 32 branches to the first and second side bypass lines 33 and 34. The first side bypass line 33 is connected to the shuttle valve 29, and also connected to the drain line 35 communicating with the tank T while passing through only the side bypass portion 19*a* of the arm control valve 19. On the other hand, the second side bypass line 34 is connected to the drain line 35 while passing in series through the side bypass portions of the control valves other than the arm control valve 19, namely, the side bypass portions 20*a*, 18*a*, 16*a* and 17*a* of respective control valves 20, 18, 16 and 17 for right travel, left travel, boom and bucket, in sequence from the top of FIG. 1. From the second side bypass line 34 branches off a line leading to the second pilot port 22*b*, at an intermediate portion thereof. Moreover, the side bypass lines 33 and 34 are provided with respective throttles 33*a* and 34*a* in respective upstream end portions thereof which are also portions downstream of the branching points of the side bypass lines 33 and 34. Respective opening surface areas of the throttles 33*a* and 34*a* is set so that, even if one of the side bypass lines 33 and 34 is connected to the tank, the other pilot pressure to be maintained.

The side bypass portions 16*a* to 20*a* of the control valves 16 to 20 have their respective positions corresponding to the three positions of the control valves 16 to 20. Among the side bypass portions, the side bypass portions 20*a* and 18*a* of the right travel and left travel control valves 20 and 18 open the second side bypass line 34 at all times, irrespective of the position of the control valves 20 and 18, furthermore, when the control valves 20 and 18 are in their neutral positions, forming a fluid path for connecting the second side bypass line 34 to the direct tank line 35. The side bypass portion 19*a* of the arm control valve 19 opens the first side bypass line 33 when the arm control valve 19 is in its neutral position, while blocks the first side bypass line 33 when the arm control valve 19 is in its operating position. Similarly, each of the side bypass portions 16*a* and 17*a* of the boom and bucket control valves 16 and 17 opens the second side bypass line 34 when each of the control valves 16 and 17 is in its neutral position, while blocks the second side bypass line 34 when each of the control valves 16 and 17 is in an operating state. The switching between supply and block of primary pilot pressure to the first and second pilot ports 22*a* and 22*b* of the merge valve 22 is thus carried out, in accordance with the operational circumstances of the control vales 19, 20, 18, 16 and 17 other than the swivel control valve 21.

Hence, in this first embodiment (and in the second and third embodiments described below), the pilot circuit, which is connected to the pilot ports 22*a* and 22*b* of the merge valve 22 and includes the primary pilot pressure source 31 and the side bypass portions 16*a* to 20*a* provided in the control valves 16 to 20 other than the swivel control valve 21, constitutes a merge selecting control section which controls switching of the position of the merge valve 22.

Next will be described the action of the hydraulic circuit.

(1) Initial State

In an initial state where there is no operation for any of the hydraulic actuators, no pilot pressure is supplied to either of the pilot ports 22*a* and 22*b* of the merge valve 22; the merge valve 22 is therefore kept at the first position P1 shown in the drawing. In this first position P1, the merge valve 22 forms a fluid path for permitting the third pump fluid to be supplied to the boom and bucket control valves 16 and 17 of the first circuit C1 through the first merge line 26.

(2) Swivel Operation and Boom Cylinder Single Operation

Since the merge valve 22, in its first position P1, connects the unload line 24 to the tank line 28, the pump pressure of the third pump 15 cannot be raised in the case of no swivel operation. Hence, in this state, even if the boom cylinder 6 is operated in the boom raising direction or the bucket cylinder 8 is operated, no merge of the flow for the cylinders 6 or 8 is performed. Conversely, when the swivel control valve 21 alone is operated, the swivel motor 12 is driven, while the merge valve 22 is kept in its neutral position, namely, the first position P1.

(3) Boom Raising/Swivel Operation

Upon a boom raising operation and a swivel operation in the state shown in FIG. 1, the side bypass portion 16*a* of the boom control valve 16 shuts off the second bypass line 34, but no pilot pressure is supplied to the second pilot port 22*b*, unless the travel control valves 20 and 18 for the left and right travel motors 10 and 11 are operated, because the control valves 20 and 18 are kept in their respective neutral positions to make the side bypass portions 20*a* and 18*a* bring the second bypass line 34 into communication with the direct tank line 35. Besides, since the first bypass line 33 is kept opened to communicate with the drain line 35 unless the arm control valve 19 is operated, no pilot pressure is supplied also to the first pilot port 22*a*. The merge valve 22 is thus kept at its first position P1, irrespective of the boom raising operation. Hence, even if a boom raising operation is added when a swivel operation is performed, the merge valve 22 kept its first position P1 with no position switching thereof is performed.

In this first position P1, the merge valve 22 permits the third pump fluid to be supplied to the boom cylinder 6 in parallel with the swivel motor 12. Here, the swivel pressure in acceleration is greater than the boom holding pressure, and the boom raising/swivel is therefore carried out in synchronization with the boom holding pressure which is a lower-pressure. Besides, the throttle 36, provided in the flow path for causing the third pump fluid to merge into the first circuit in the first position P1, performs the function of raising the swivel pressure during the combined operation of the boom raising operation and the swivel operation to secure the swivel acceleration performance.

(4) Arm Operation

When the arm control valve 19 is operated in the arm retracting direction or the arm push direction in the state shown in FIG. 1, the side bypass portion 19*a* thereof shuts off the first side bypass line 33 to permit the primary pilot pressure to be supplied to the first pilot port 22*a* of the merge valve 22 through the shuttle valve 29, thereby switching the merge valve 22 to its second position P2. This prohibits the third pump fluid from being flowed into the first circuit C1 through the first merge line 26 while permitting the third pump fluid being flowed through the unload line 24 to merge into the second pump fluid in the second circuit C2, that is, the hydraulic fluid discharged from the second pump 14, through the second merge line 27. This merge accelerates the motion of the arm cylinder 7.

(5) Boom Lowering Operation

When a boom lowering operation is carried out in the state in FIG. 1, a boom lowering pilot pressure is supplied to the first pilot port 22*a* of the merge valve 22, thus switching the merge valve 22 to the second position P2 to block the parallel line 25 from the first merge line 26 and connect the unload line 24 to the second merge line 27. The hydraulic fluid flowed in the second merge line 27 is let to the tank T directly if the arm control valve 19 is not being operated. Thus, the boom lowering operation prevents the third pump fluid from being supplied to the boom cylinder 6 and, in the case of the boom lowering/swiveling operation, no merge is performed differently from the case of the boom raising/swivel operation; therefore, the swivel pressure is prevented from declination involved by the boom lowering pressure. This enables good swivel acceleration performance to be secured. Besides, it is possible to switch the merge valve 22 to the second position P2 simply by introducing the boom lowering pilot pressure to the first pilot port 22*a* of the merge valve 22, which allows the circuit composition for switching the merge valve 22 to the second position to be simplified.

(6) Dual Travel Operation/Other Actuator Operation

When both the left and right travel control valves 18 and 20 are operated, the fluid path formed in the side bypass portions 18*a* and 20*a* of the control valves 18 and 20 to connect the second side bypass line 34 to the direct tank line 35 is eliminated; however, if none of the other control valves 19, 16 and 17 are operated at this time, both of the first and second side bypass lines 33 and 34 are brought into communication with the tank T through the drain line 35 to thereby prevent the primary pilot pressure from being introduced into either of the pilot ports 22*a* and 22*b* of the merge valve 22, thus keeping the merge valve 22 in the first position P1.

However, in this state, if an operation is performed for any of the control valves 19, 16 and 17 corresponding to the hydraulic actuators other than the travel motors, the side bypass portion of the control valve having been operated shuts off the side bypass line 33 or from the drain line 35, thereby permitting the primary pilot pressure to be introduced into the second pilot port 22*b* to switch the merge valve 22 to its third position P3. The merge valve 22, in this third position P3, forms a fluid path permitting the third pump fluid to pass through the unload line 24 and the parallel line 25 and further through the first and second merge lines 26 and 27 respectively to be flowed into the first and second circuits C1 and C2. Thus, the operation of the hydraulic actuators other than the travel motors is guaranteed during the travel by both the left and right motors.

According to this hydraulic circuit, the merge valve 22 is kept at the first position P1 either of when only a swivel operation is performed and when a swivel operation and a boom raising operation are performed simultaneously, and forms, at this first position P1, such a merge fluid path as allows the third pump fluid to be supplied to the swivel motor and the boom cylinder 6 in parallel; therefore, even if a boom raising operation is carried out during a swivel operation, the merge valve 22 is not moved while just the boom control valve 16 is operated in addition to the swivel control valve 21. Hence, differently from an art of switching a merge valve when a boom raising/swivel operation is performed such as the prior art described in Patent Document 1, there occurs no sudden changes in the swivel pressure, namely, no swivel shocks, due to delay in the switching (merge of flows).

Furthermore, if neither a swivel operation nor a boom operation is carried out when the merge valve 22 is in the first position P1, the third pump fluid is let to the tank T directly through the direct tank line 28, without passing through the first circuit C1 or the second circuit C2, which allows the pressure loss on the return side when no operation is being performed to be decreased.

Moreover, during no swivel operation, the swivel control valve 21 stay in the neutral position to connect the pump line 23 to the unload line 24, thus preventing the third pump fluid from merge into the first circuit C1. In other words, single boom raising operation involves no merge action and no acceleration in the boom raising action. The operator is therefore allowed to perform the operation with a normal feeling and motion.

On the other hand, when a boom raising operation and a swivel operation are carried out simultaneously, the throttle 36 in the merge valve 22 at the first position P1 increases the swivel pressure to thereby enable the swivel acceleration performance to be guaranteed.

Figure 3:
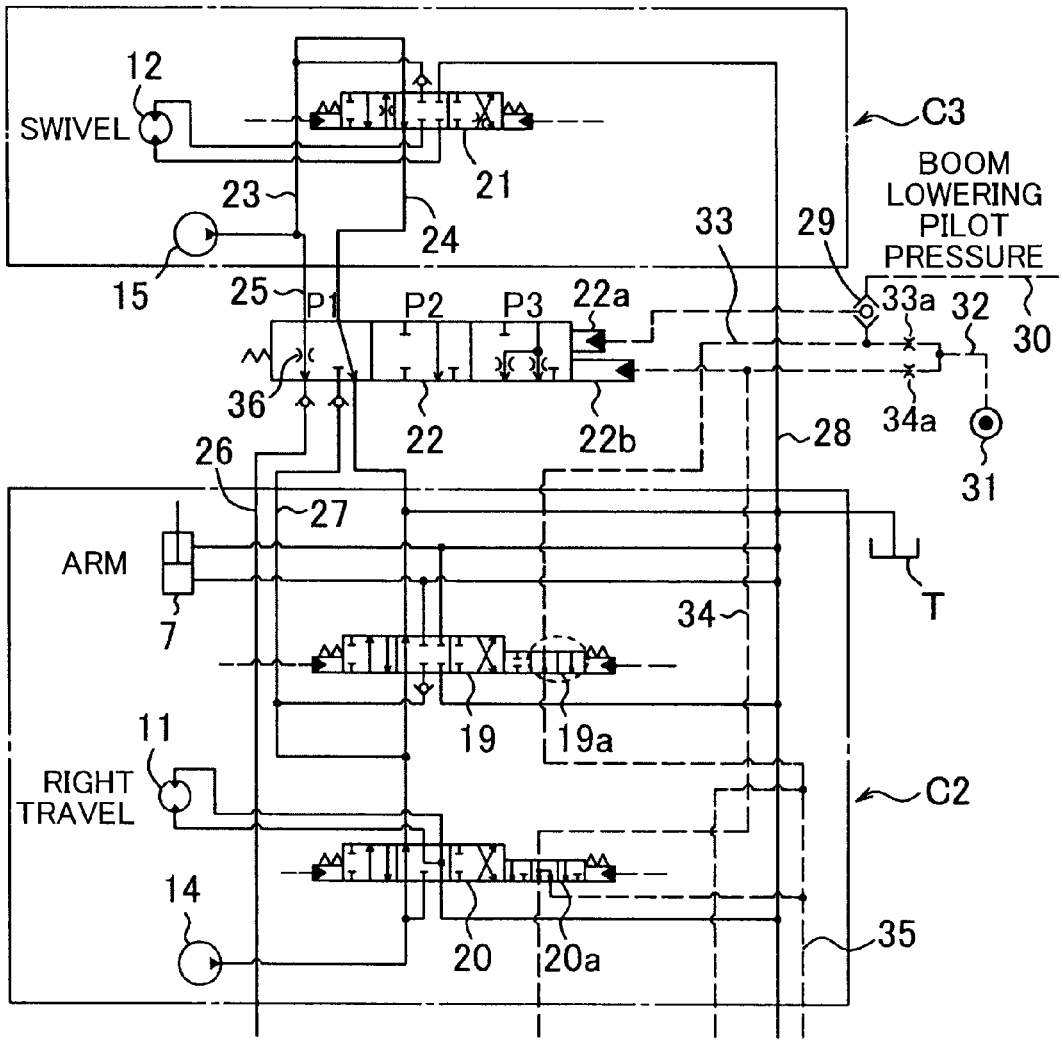
FIG. 3 is a diagram showing a part of a hydraulic pressure circuit illustrating a second embodiment of the present invention.

Next will be described a second embodiment of the present invention with reference to FIG. 3. FIG. 3 shows only the composition of the second and third circuits C2 and C3, that is, a composition involving the arm control valve 19 and the vicinity thereof, while omitting an indication of the first circuit C1.

The second embodiment differs from the first embodiment only in the portion surrounded by the dotted lines in FIG. 3. Specifically, in the apparatus according to this second embodiment, as to the positions included in the side bypass portion 19*a* of the arm cylinder control valve 19, not only the neutral position but also the position corresponding to an operation in the arm push direction (a direction for expanding the arm cylinder 7) is set so as to form a fluid path which opens the first side bypass line 33. The reason for this is as follows.

In excavation work, for an arm pull operation of expanding the arm cylinder 7 to actuate the arm 4 shown in FIG. 5 backwards, it is desirable to cause the third pump fluid to merge into the second pump fluid, which is the hydraulic fluid discharged from the second pump 14, to accelerate the arm 4. On the other hand, for an arm push operation of contracting the arm cylinder 7 to actuate the arm 4 forwards, the above merge is undesirable because the cross-sectional area difference between the head side chamber and the rod side chamber in the arm cylinder 7 amplify the increase in the return flow rate due to the merge and the increase in pressure loss due to the flow rate increase.

Thus setting the fluid path in the side bypass portion 19*a* makes it possible to allow the merge to be performed to accelerate the arm 4 when the arm pull operation is performed while preventing the merge to suppress pressure loss due to increase in the return flow rate when an arm push operation is performed. Specifically, when the arm cylinder control valve 19 is operated in the arm pull direction (to the left-hand position in FIG. 3), the side bypass portion 19*a* blocks the first side bypass line 33, similarly to the first embodiment, to thereby switch the merge valve 22 to the second position, thus prohibiting the third pump fluid from merge into the first circuit C1, while permitting the third pump fluid flowed in the unload line 24 to merge into the second pump fluid through the second merge line 27. This allows the extending action of the arm cylinder 7 to be accelerated. On the other hand, when the arm cylinder control valve 19 is operated in the arm push direction (to the right-hand position in FIG. 3), the side bypass portion 19*a* opens the first side bypass line 33, similarly to the neutral position, to hold the merge valve 22 at the first position, thereby prohibiting the third pump fluid from merge into the second pump fluid. This suppresses the return flow rate of the hydraulic fluid from the arm cylinder 7 to decrease the pressure loss.

Next will be described a third embodiment of the present invention with reference to FIG. 4.

The purpose of the composition according to this third embodiment is as follows. The excavation work performed by the hydraulic excavator shown in FIG. 5 is collaborative one by the arm 4 and the bucket 5. Hence, as to this excavation work, in the case of switching the merge valve 22 to the second position P2 only on the basis of an operation of the arm 4 to cause the third pump fluid to merge into the arm cylinder 7, the flow rate of the hydraulic fluid supplied to the bucket cylinder 8 can be decreased when a part of the merging fluid is relieved, resulting in the declination in the motion of the bucket 5. The object of this third embodiment is to suppress the declination in the motion of the bucket 5.

Figure 4:
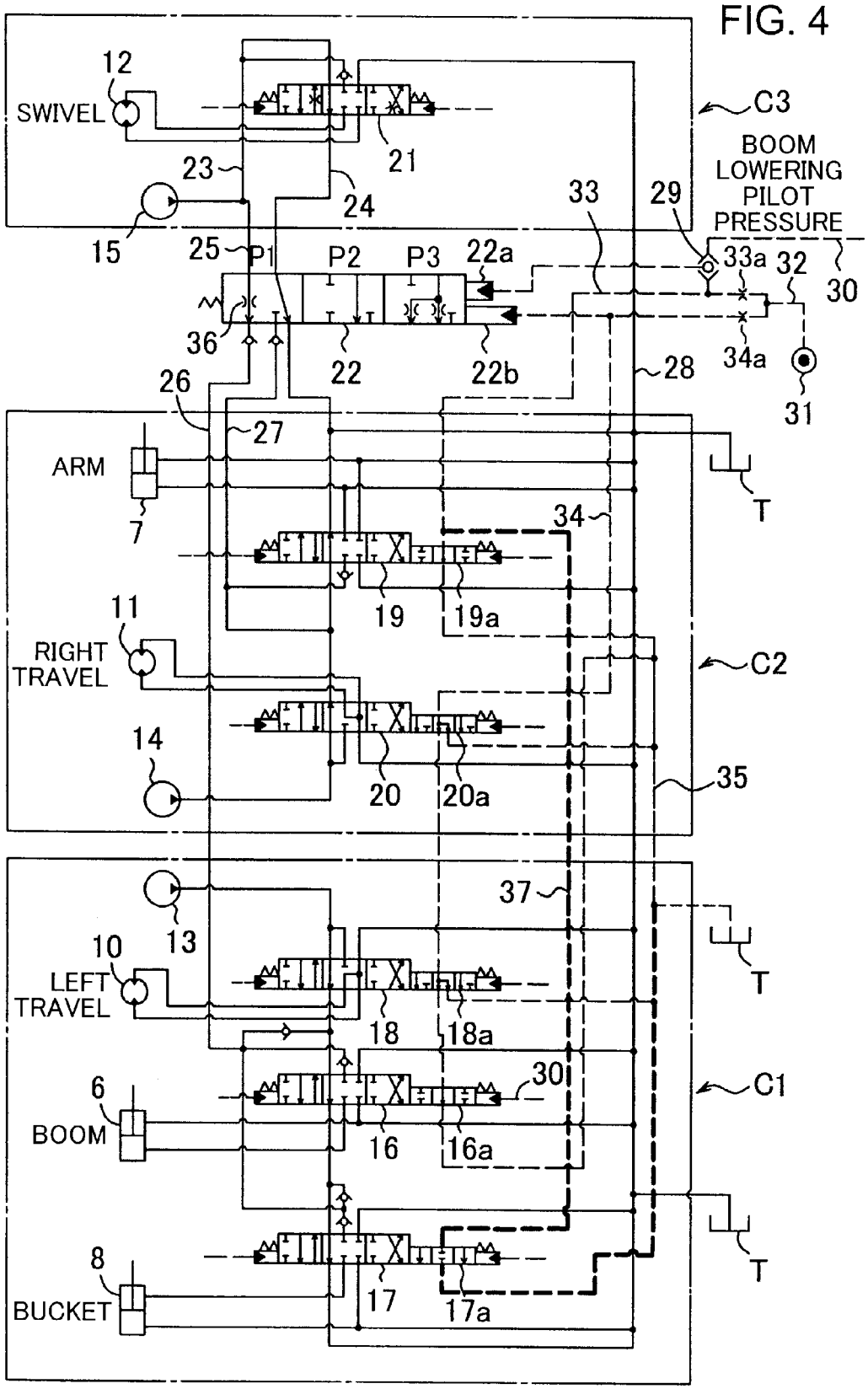
FIG. 4 is a hydraulic pressure circuit diagram showing a third embodiment of the present invention.

Specifically, according to this third embodiment, a third side bypass line 37 indicated by the thick dotted line in FIG. 4 is added to the circuit shown in FIG. 1. The third side bypass line 37 branches from the first side bypass line 33 at the portion upstream of the side bypass portion 19*a* of the arm control valve 19, passing through the side bypass portion 17*a* of the bucket control valve 17 to reach the drain line 35. Besides, conversely to the side bypass portion 17*a* shown in FIG. 1, the side bypass portion 17*a* according to this third embodiment is designed to block the third side bypass line 37 when the bucket control valve 17 is in a neutral position and to open the third side bypass line 37 when the bucket control valve 17 is operated from the neutral position. On the other hand, the second side bypass line 34 directly reaches the drain line 35 while not passing through the side bypass portion 17*a* of the bucket control valve 17 but passing through the side bypass portion 16*a* of the boom control valve 16.

In this circuit, even if the arm control valve 19 is being operated, the side bypass portion 17*a* opens the third side bypass line 37 upon operation of the bucket control valve 17 to prohibit the pilot pressure from be supplied to the first pilot port 22*a*. Hence, in the case of the simultaneous operations of the arm 4 and the bucket 5, the merge valve 22 is held at the first position P1 and the third pump fluid is prohibited from merge into the arm cylinder 7. This makes it possible to secure the flow rate of hydraulic fluid to be supplied to the bucket cylinder 8 to guarantee good movement of the bucket 5, even in circumstances where a part of the hydraulic fluid supplied to the arm cylinder 7 is relieved, for example, due to the hardness of the ground to be excavated.

The present invention is not limited to the embodiments described above but can include, for example, embodiments as follows.

The present invention also permits a hydraulic actuator other than the hydraulic actuators shown in FIG. 1 to FIG. 4 to be added. For example, it is also permitted to add a spare service actuator or a swing cylinder adapted to cause the boom 3 to swing in the left/right direction to the second circuit C2, or to add a dozer cylinder to the third circuit C3.

Furthermore, the present invention can be applied to cases which adopt a circuit composition other than the travel-prioritizing circuit, as described in the embodiments given above, in which the travel motors 10 and 11 are arranged on the furthest upstream side of the first and second circuits C1 and C2.

While, in the above embodiments, the merge selecting control section which controls the switching of position of the merge valve 22 is constituted by a pilot circuit of the merge valve 22, the circuit including side bypass portions 16*a* to 20*a* provided in the control valves 16 to 20 and a pilot pressure source 31, the merge selecting control section may comprise an operation detector (for example, a pilot pressure sensor) for detecting operation of the control valves, an electromagnetic switching valve for switching the supply of pilot pressure to the merge valve 22, and a control circuit for controlling the switching of the electromagnetic switching valve on the basis of a detection signal output by the operation detector.

Moreover, the present invention is not limited to a hydraulic excavator, but may be applied to a crushing or wrecking machine which is composed by utilization of a base machine of the hydraulic excavator so as to attach a breaker or openable and closable pressure crushing device to the base machine, instead of the bucket.

As described above, the present invention provides a construction machine which is capable of effectively suppressing shocks in the swivel torque due to switching of a merge valve when a boom raising operation and a swivel operation are carried out simultaneously. This construction machine comprises: a lower travel body; an upper swivel body mounted swivelably on the lower travel body; a swivel motor which hydraulically drives the upper swivel body to swivel it; a working attachment installed on the upper swivel body and including a boom capable of being raised and lowered, a boom cylinder which hydraulically raises and lowers the boom, an arm which is pivotably connected to a front end of the boom, and an arm cylinder which hydraulically causes the arm to pivot; a hydraulic actuator circuit which has a first circuit including the boom cylinder and a boom control valve for controlling an operation of the boom, a second circuit including the arm cylinder and an arm control valve for controlling an operation of the arm cylinder, and a third circuit including the swivel motor and a swivel control valve for controlling an operation of the swivel motor; a first pump which is a hydraulic pressure source of the first circuit; a second pump which is a hydraulic pressure source of the second circuit; a third pump which is a hydraulic pressure source of the third circuit; a merge valve having a first position and a second position; and a merge selecting control section which controls switching of the position of the merge valve. At the first position, the merge valve forms a fluid path for causing the third pump fluid to merge into the first circuit in parallel with the swivel motor, and, at the second position, the merge valve prohibits the third pump fluid from merging into the first circuit. The merge selecting control section holds the merge valve at the first position, either of when only a swivel operation, which is an operation for the swivel motor, is performed and when a boom raising operation, which is an operation for raising the boom, is performed during the swivel operation.

In this circuit, the merge valve is kept at the first position when a boom raising operation is performed simultaneously with a swivel operation, in addition to when only the swivel operation is performed, to cause the third pump fluid to merge into the first circuit (boom cylinder) including the boom cylinder; therefore, differently from the prior art where the position of the merge valve is switched between a first case where only a swivel operation is performed and a second case where a boom raising operation and a swivel operation are carried out simultaneously, sudden changes in the swivel pressure, namely, swiveling shocks, is prevented from occurring due to the delay in the switching of position of the merge valve.

Desirably, the arm cylinder expands to move the arm backwards; the second position is a position for causing the third pump fluid to merge into the second circuit; and the merge selecting control section switches the merge valve to the second position, irrespective of the presence or absence of the swivel operation and the presence or absence of the boom raising operation, at least when an arm pull operation for actuating the arm to move it backward. The merge into the second circuit enables the motion of the arm cylinder in the arm pull direction to be accelerated, thus improving the work efficiency.

Moreover, the merge selecting control section, preferably, holds the merge valve at the first position in the event of an arm push operation for moving the arm forwards. Although the arm cylinder is contracted to actuate the arm in the push direction and performing the merge in the contraction involves marked increase in the return side flow rate due to the difference between the cross-sectional surface area of the head side chamber of the arm cylinder and the cross-sectional surface area of the rod side chamber, preventing the third pump fluid from the merge during the arm push operation as described above enables the increase in pressure loss due to the increase in the return side flow rate to be suppressed.

In the case where the construction machine according to the present invention further comprises a bucket attached to a front end of the arm, a bucket cylinder which operates the bucket, and a bucket control valve which controls an operation of the bucket cylinder, it is desirable that: the bucket cylinder and the bucket control valve are included in the first circuit; and the merge selecting control section holds the merge valve at the first position when an operation of the arm and an operation of the bucket are carried out simultaneously, irrespective of a direction of the operation of the arm.

Since excavation work is collaborative one by the arm and the bucket, if switching the merge selecting control section switches the merge valve to the second position during excavation work on the basis of only an arm operation, the supply flow rate to the bucket cylinder can be decreased when the merging fluid in the second circuit is relieved, thereby deteriorating the movement of the bucket; however, keeping the merge valve at the first position in this case to prohibit the fluid from merge into the second circuit enables satisfactory movement of the bucket to be guaranteed, thus allowing the cycle time to be shortened.

Desirably, the merge selecting control section switches the merge valve to the second position when a boom lowering operation for moving the boom downwards is being performed. Since the weight of the boom normally acts on the boom cylinder in the boom lowering direction, the pressure in the boom cylinder during a boom lowering operation is generally low. Hence, the merge of the third pump fluid into the first circuit (boom cylinder) including the boom cylinder when a swivel operation and a boom lowering operation are performed may decrease the swivel pressure to deteriorate the swivel acceleration performance. However, switching the merge valve to the second position to shut off the merge of the third pump fluid into the first circuit when a boom lowering operation is performed enables the swivel acceleration performance during a boom lowering/swiveling operation to be enhanced. Besides, leading the third pump fluid to the second circuit allows the hydraulic actuator included in the second circuit to be accelerated when it is operated, while, if the hydraulic actuator is not operated, the third pump fluid is let to the tank.

Furthermore, in the case where the merge valve is a pilot controlled selector valve having a pilot port, it is preferable that the merge selecting control section switches the merge valve to the second position by introducing, to the pilot port of the merge valve, a boom lowering pilot pressure which is introduced to the boom control valve in order to operate the boom control valve in the boom lowering direction. This merge selecting control section can switch the merge valve to the second position with a simple circuit composition.

Desirably, the merge valve has an throttle in a flow path, in the first position, for causing the third pump fluid to merge into the first circuit. This throttle raises the swivel pressure by restricting the flow rate of the hydraulic fluid merging into the first circuit when a boom raising operation and swivel operation are being performed, thereby allowing the swivel acceleration performance to be guaranteed.

There are no particular restrictions on the position of the merge valve when a single boom raising operation is performed while no swivel operation is performed. Even if the position of the merge valve when a single boom raising operation is performed is the first position, the third pump fluid can be prevented from merge into the first circuit if the merge valve is configured to connect the unload line of the third circuit to the tank at the first position, because the third pump fluid is allowed to be let into the tank through the unload line and the merge valve when the swivel control valve is not operated. This prevents the boom raising motion from acceleration due to the merge performed when a swivel operation is not performed and a single boom raising operation is performed, thus allowing an operator to perform the operation with a normal feeling and motion.

Moreover, desirably, the merge valve connects the unload line of the third circuit directly to the tank at the first position. This merge valve, which is capable of letting the third pump fluid directly into the tank so as to bypass the first circuit and the second circuit, at the first position, when neither of swivel and boom operations are performed, can reduce the return-side pressure loss when no operation is performed.

The invention claimed is:

1. A construction machine, comprising:

a lower travel body;

an upper swivel body mounted swivelably on the lower travel body;

a swivel motor which hydraulically drives the upper swivel body to swivel the upper swivel body;

a working attachment installed on the upper swivel body and including a boom capable of being raised and lowered, a boom cylinder which hydraulically raises and lowers the boom, an arm pivotably connected to a front end of the boom, and an arm cylinder which hydraulically causes the arm to pivot;

a hydraulic actuator circuit which has a first circuit including the boom cylinder and a boom control valve for controlling an operation of the boom, a second circuit including the arm cylinder and an arm control valve for controlling an operation of the arm cylinder, and a third circuit including the swivel motor and a swivel control valve for controlling an operation of the swivel motor;

a first pump which is a hydraulic pressure source of the first circuit;

a second pump which is a hydraulic pressure source of the second circuit;

a third pump which is a hydraulic pressure source of the third circuit;

a merge valve which has a first position and a second position and which forms a fluid path for causing third pump fluid which is hydraulic fluid discharged by the third pump to merge into the first circuit in parallel with the swivel motor at the first position and prohibits the third pump fluid from the merge into the first circuit at the second position; and a merge selecting control section which controls switching of the position of the merge valve, wherein the merge selecting control section holds the merge valve at the first position when only a swivel operation, which is an operation for the swivel motor, is performed and the merge selecting control section holds the merge valve at the first position when a boom raising operation, which is an operation for moving the boom in a raising direction, is performed during the swivel operation.

2. The construction machine according to claim 1, wherein:

the arm cylinder expands to actuate the arm backwards; the second position is a position for causing the third pump fluid to merge into the second circuit; and the merge selecting control section switches the merge valve to the second position at least when an arm pull operation for actuating the arm to move the arm backwards is performed, irrespective of the presence or absence of the swivel operation and the presence or absence of the boom raising operation.

3. The construction machine according to claim 2, wherein the merge selecting control section holds the merge valve at the first position when an arm push operation for moving the arm forwards is performed.

4. The construction machine according to claim 3, further comprising a bucket attached to a front end of the arm, a bucket cylinder which actuates the bucket, and a bucket control valve which controls an operation of the bucket cylinder, wherein the bucket cylinder and the bucket control valve are included in the first circuit, and the merge selecting control section holds the merge valve at the first position when an operation of the arm and an operation of the bucket are carried out simultaneously, irrespective of a direction of the operation of the arm.

5. The construction machine according to claim 1, wherein the merge selecting control section switches the merge valve to the second position when a boom lowering operation for moving the boom downwards is performed.

6. The construction machine according to claim 5, wherein the merge valve is a pilot controlled selector valve having a pilot port, the merge selecting control section switches the merge valve to the second position by introducing, to the pilot port of the merge valve, a boom lowering pilot pressure which is introduced to the boom control valve in order to operate the boom control valve in the boom lowering direction.

7. The construction machine according to claim 1, wherein the merge valve has a throttle in a flow path for causing the third pump fluid to merge into the first circuit at the first position.

8. The construction machine according to claim 1, wherein the merge selecting control section holds the merge valve at the first position when a swivel operation is not performed and a single boom raising operation is performed, and the merge valve connects an unload line of the third circuit to a tank at the first position.

9. The construction machine according to claim 8, wherein the merge valve connects the unload line of the third circuit directly to the tank at the first position.

* * * * *